US006157274A

United States Patent [19]

Tada et al.

[11] Patent Number: 6,157,274

[45] Date of Patent: Dec. 5, 2000

[54] BAND ELIMINATION FILTER AND DUPLEXER

[75] Inventors: Hitoshi Tada; Hideyuki Kato, both of Ishikawa-ken, Japan

[73] Assignee: Murata Manufacturing Co., Ltd., Japan

[21] Appl. No.: 09/212,958

[22] Filed: Dec. 16, 1998

[30] Foreign Application Priority Data

Dec. 22, 1997 [JP] Japan ..... 9-353674

[51] Int. Cl.[7] ..... H01P 1/20; H01P 5/12

[52] U.S. Cl. ..... 333/204; 333/202; 333/205; 333/134

[58] Field of Search ..... 333/202, 204, 333/205, 206, 132, 134

[56] References Cited

U.S. PATENT DOCUMENTS

| | | | |
|---|---|---|---|
| Re. 34,898 | 4/1995 | Turunen et al. | 333/206 |
| 3,153,209 | 10/1964 | Kaiser | 333/204 |
| 4,327,342 | 4/1982 | De Ronde | 333/204 |
| 5,172,084 | 12/1992 | Fiedziuszko et al. | 333/204 |
| 5,659,274 | 8/1997 | Takahashi et al. | 333/204 |
| 5,721,195 | 2/1998 | Grothe et al. | 333/205 |

FOREIGN PATENT DOCUMENTS

| | | |
|---|---|---|
| 0573985 | 12/1993 | European Pat. Off. . |
| 0646981 | 4/1995 | European Pat. Off. . |
| 3304862 | 8/1984 | Germany . |
| 0099002 | 6/1983 | Japan . |
| 9139612 | 5/1997 | Japan . |

OTHER PUBLICATIONS

UK Search Report dated Mar. 31, 1999.

*Primary Examiner*—Robert Pascal
*Assistant Examiner*—Patricia T. Nguyen
*Attorney, Agent, or Firm*—Ostrolenk, Faber, Gerb & Soffen, LLP

[57] ABSTRACT

The invention provides a band elimination filter, comprising: a ring shaped resonator adapted to resonate in two orthogonal modes combined together; one input-output terminal electrically connected to said ring shaped resonator; and a perturbation portion disposed in said ring shaped resonator. The perturbation portion may be composed of a portion of said ring shaped resonator at which a pattern width is different from the other portion of said ring shaped resonator. Or, the perturbation portion may be composed a lumped constant passive element.

13 Claims, 8 Drawing Sheets

BAND ELIMINATION FILTER AND DUPLEXER

BACKGROUND OF THE INVENTION

1. Field of the Invention

The present invention relates to a band elimination filter and a duplexer, and more particularly, to a band elimination filter and a duplexer for use in a radio communication apparatus and the like which operate in a microwave band and a millimeter wave band.

2. Description of the Related Art

Recently, as a filter for use in radio communication apparatus which operates in a microwave band and a millimeter wave band, there have been proposed a band elimination filter including a ring shaped resonator (see Japanese Examined Patent Publication No. 2516984), and a band-pass filter including a ring shaped resonator (see Electronic Information Communication Society Engineering Report (Japanese name: Denshi-joho-tsushin gakkai-giho), May, 1996).

The conventional band-pass filter resonators are adapted to resonate in two orthogonal modes combined together, namely, in a dual mode. However, the filters have a problem that their insertion loss is high, due to the fact that the filters are band-pass filters.

The ring shaped resonator used in the conventional band elimination filter aims at enhancing the attenuation factor in a passing-band of the band-pass filter. Moreover, the two orthogonal modes of resonance are independent from each other. This causes a problem that an input-output coupling capacitor, in addition to the ring shaped resonator, needs to be inserted between an input-output terminal and the ring shaped resonator for construction of the band elimination filter.

SUMMARY OF THE INVENTION

Preferred embodiments of the present invention are provided to overcome the above problems, and provide a band elimination filter and a duplexer in which it is unnecessary to insert an input-output coupling capacitor and the like between the input-output terminal and the ring shaped resonator.

The preferred embodiment of the present invention provides a band elimination filter, comprising: a ring shaped resonator adapted to resonate in two orthogonal modes combined together; one input-output terminal electrically connected to said ring shaped resonator; and a perturbation portion disposed in said ring shaped resonator.

In the above described band elimination filter, said perturbation portion may be disposed at at least one portion at a distance (an electrical length) of 45° or 135° from a connecting portion where said input-output terminal is connected to said ring shaped resonator In the above described band elimination filter, said perturbation portion may be composed of a lumped constant passive element.

In the above described band elimination filter, said perturbation portion may be composed of a portion of said ring shaped resonator at which a pattern width is different from the other portion of said ring shaped resonator.

The preferred embodiment of the present invention also provides a band elimination filter including a plurality of the above described band elimination filters which are connected to each other with 90° phase shift.

In the above-described configuration, the ring shaped resonator is divided into two regions by a center line of the perturbation portion. That is, in the resonance of the ring shaped resonator in the region where the input-output terminal is connected, a wide-bandwidth band-pass filter characteristic can be obtained. In addition, in the resonance of the ring shaped resonator in the region where the input-output terminal is not connected, a narrow-bandwidth band elimination filter (trap) characteristic can be attained.

As a result, the band elimination filter can be attained without an input-output coupling capacitor and the like inserted between the input-output terminal and the ring shaped resonator. Moreover, the multi-stage filter can be constructed by connection of a plurality of the band elimination filters with a 90° phase difference provided. Thus, the filter having different attenuation characteristics can be produced.

The preferred embodiment of the present invention further provides a duplexer, comprising: a transmission filter, comprising at least one first ring shaped resonator adapted to resonate in two orthogonal modes combined together; one first input-output terminal electrically connected to said first ring shaped resonator; and a first perturbation portion disposed in said first ring shaped resonator; and a receiving filter, comprising at least one second ring shaped resonator adapted to resonate in two orthogonal modes combined together; one second input-output terminal electrically connected to said second ring shaped resonator; and a second perturbation portion disposed in said second ring shaped resonator.

By the above described configuration, the duplexer having different attenuation characteristics can also be produced. Further, the duplexer including the ring shaped resonator for resonating in two orthogonal modes combined together is formed on a dielectric substrate, contributed by the above configuration, and can be miniaturized with a reduced height.

Other features and advantages of the present invention will become apparent from the following description of preferred embodiments of the invention which refers to the accompanying drawings, wherein like reference numerals indicate like elements to avoid duplicative description.

DETAILED DESCRIPTION OF THE PREFERRED EMBODIMENTS

Figure 1:
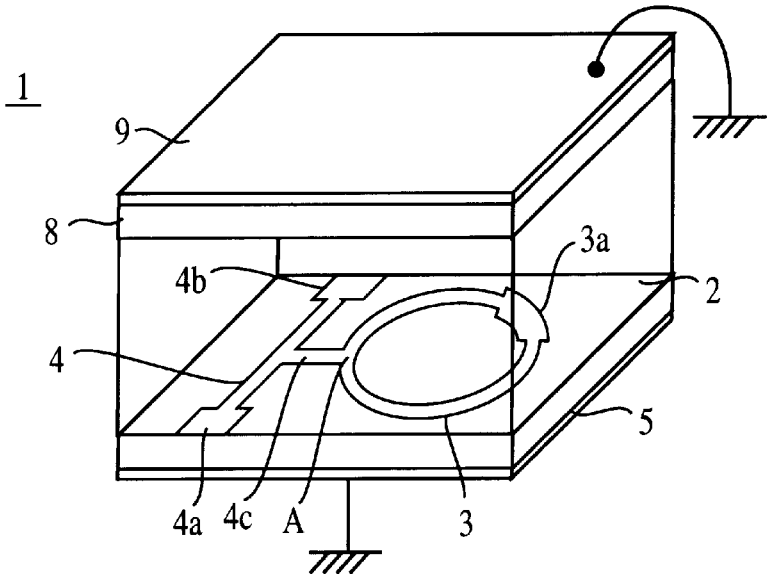
FIG. 1 is an exploded perspective view of a band elimination filter according to a first preferred embodiment of the present invention.
Figure 2:
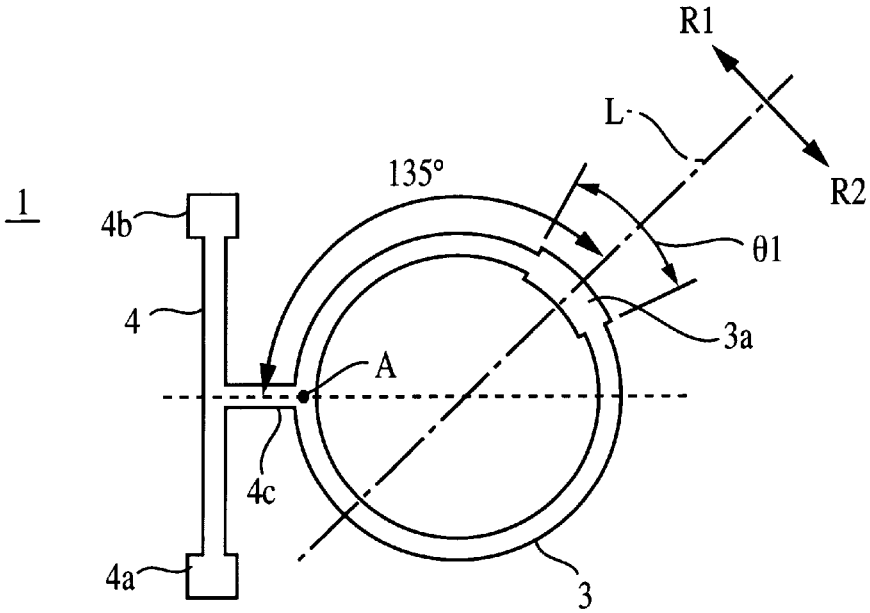
FIG. 2 is a plan view of the band elimination filter of FIG. 1.
Figure 3:
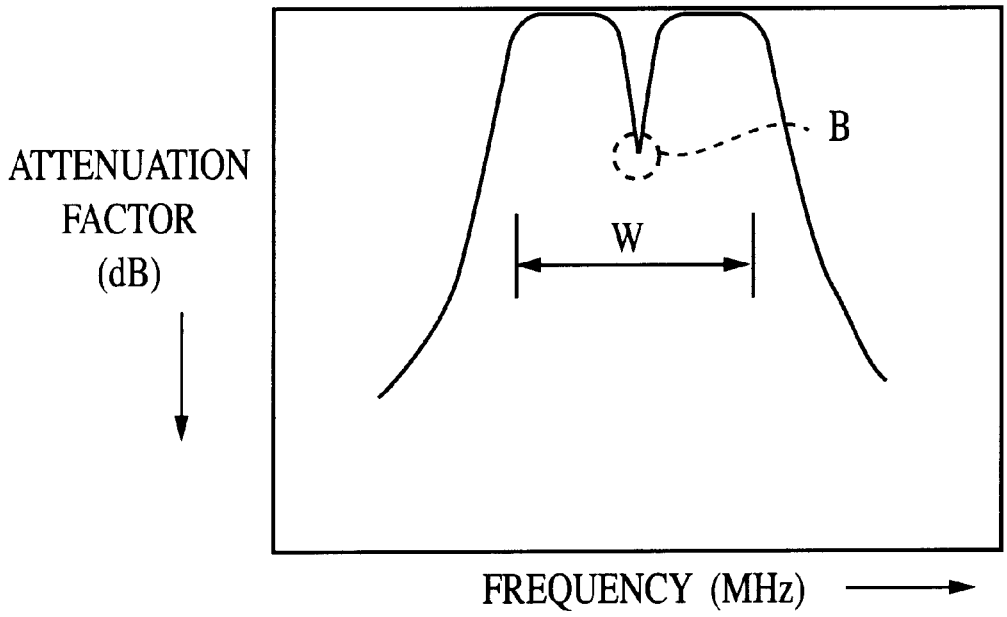
FIG. 3 is a graph showing the attenuation characteristic of the band elimination filter of FIG. 1.

[First Preferred Embodiment, FIGS. 1 through 3]

As shown in FIG. 1, a band elimination filter 1 includes a dielectric substrate 2 having a ring shaped resonator 3 and one input-output terminal 4 electrically connected to the ring shaped resonator 3, provided on the top surface thereof, and having a grounded conductor 5 provided on substantially the entire bottom surface thereof. In addition, the ring shaped resonator 3 and the input-output terminal 4 of the band elimination filter 1 are covered, from the upper side thereof, with a dielectric substrate 8 having grounded conductors 9 provided on the top and the bottom surface thereof, if necessary.

The ring shaped resonator 3 has a circular ring shape as shown in FIG. 2, and presents two orthogonal modes of resonance combined together. For the ring shaped resonator 3, a wide-pattern portion 3*a* is provided at the position 135° electrical length distant in the clockwise direction from a connection A between the ring shaped resonator 3 and the input-output terminal 4. With the wide-pattern portion 3*a*, the characteristic impedance of a part of the line of the ring shaped resonator 3 is changed stepwise. Accordingly, the ring shaped resonator 3 is adapted to resonate in the two orthogonal modes not independent from each other but combined together, namely, in a dual mode.

The input-output terminal 4 is substantially T-shaped. The input end 4*a* of the terminal 4 is exposed to the side of the dielectric substrate 2 positioned in the front of the band elimination filter 1 depicted in FIG. 1, while the output end 4*b* is exposed to the side of the dielectric substrate 2 positioned in the back of the band elimination filter 1 depicted in FIG. 1. A connecting end 4*c* connected to a center portion between the output is connected to the ring shaped resonator 3.

In the above-described configuration of the band elimination filter 1, the ring shaped resonator 3 is divided into two regions R1, R2 by the center line L of the wide-pattern portion 3*a*. That is, in the resonance of the region R1 where the input-output terminal 4 is connected, a wide-bandwidth band-pass filter characteristic can be attained as shown in FIG. 3 (see the band width W indicated by an arrow). In the resonance of the region R2 where the input-output terminal 4 is not connected, a narrow-bandwidth band elimination filter (trap) characteristic can be obtained (see a circle B drawn by the dotted line). The trap intensity (depth) can be controlled by changing the pattern width of the wide-pattern portion 3*a* and the electrical length θ1. As a result, the band elimination filter 1 for which it is unnecessary to insert an input-output coupling capacitor and the like between the input-output terminal 4 and the ring shaped resonator 3 can be realized.

Figure 4:
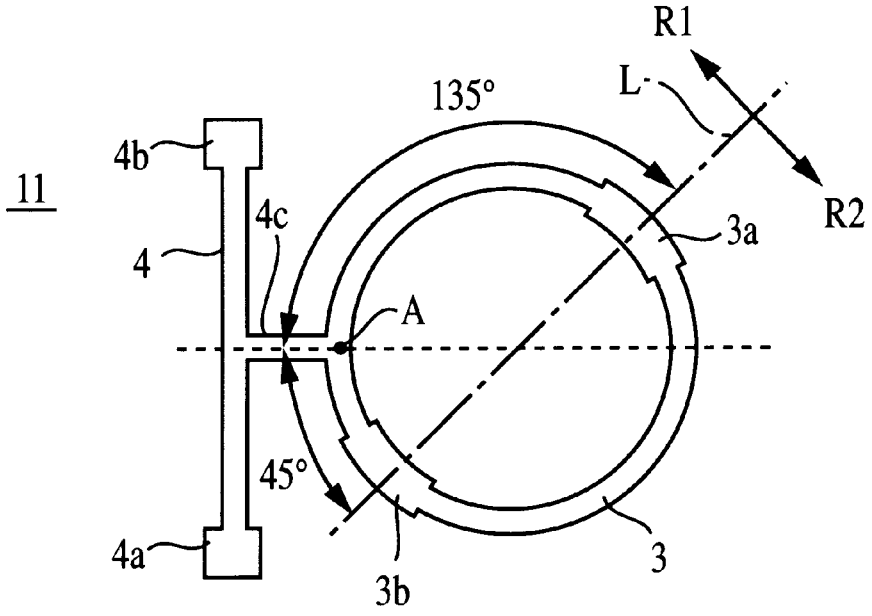
FIG. 4 is a plan view of a band elimination filter according to a second preferred embodiment of the present invention.
Figure 5:
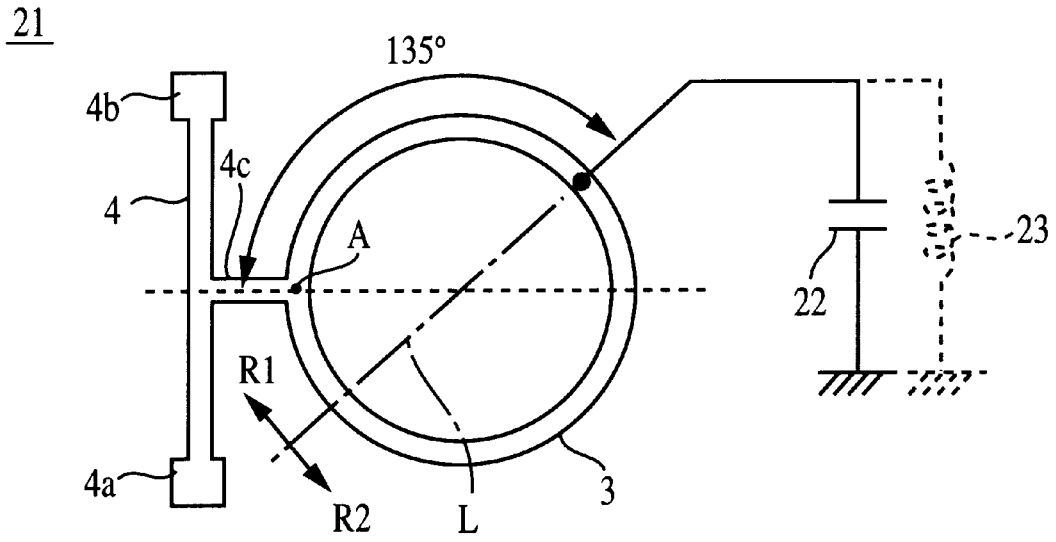
FIG. 5 is a plan view of a band elimination filter according to a third preferred embodiment of the present invention.

[Second and Third Preferred Embodiments, FIGS. 4, 5]

A band elimination filter 11 according to the second embodiment is the same as the band elimination filter 1 according to the first preferred embodiment except for a wide-pattern portion 3*b* further provided for the ring shaped resonator 3, as shown in FIG. 4. The wide-pattern portion 3*b* is provided at the position at an electrical length of 45° distance in the anti-clockwise direction from the connection A between the input-output terminal 4 and the ring shaped resonator 3. Thereby, the trap of the band elimination filter 11 can be more intensified as compared with the band elimination filter 1 according to the first preferred embodiment.

As shown in FIG. 5, a band elimination filter 21 according to a third preferred embodiment is the same as the band elimination filter 1 according to the first preferred embodiment except for the use of a lumped constant passive element instead of the wide-pattern portion 3*a* (in the case of the third embodiment, concretely, a capacitor 22 or an inductor 23 is used).

One end of the capacitor 22 or inductor 23 is electrically connected to the position of the ring shaped resonator 3 135° electrical length distant in the clockwise direction from the connection A where the input-output terminal 4 is connected to the ring shaped resonator 3. The other end of the capacitor 22 or inductor 23 is grounded. The band elimination filter 21 presents the same operation/working-effect as the band elimination filter 1 according to the above-described first preferred embodiment.

Figure 6:
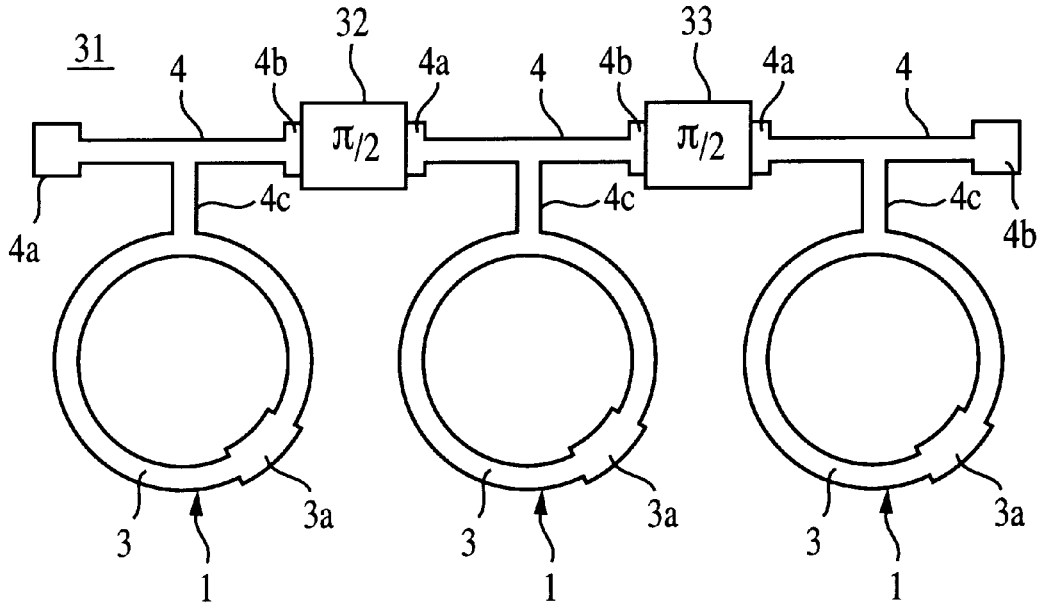
FIG. 6 is a plan view of a band elimination filter according to a fourth preferred embodiment of the present invention.
Figure 7:
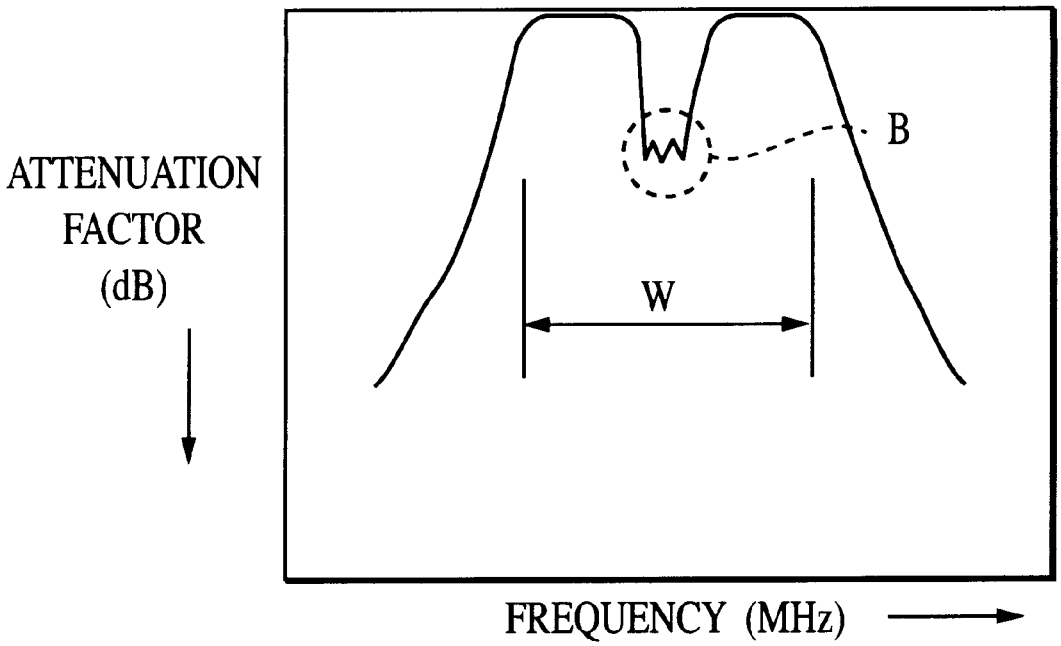
FIG. 7 is a graph showing the attenuation characteristic of the band elimination filter of FIG. 6.

[Fourth Preferred Embodiment, FIGS. 6, 7]

As shown in FIG. 6, a band elimination filter 31 according to a fourth preferred embodiment includes three band elimination filters 1 of the first preferred embodiment which are connected together longitudinally through 90° phase shifters 32, 33 so as to form multi-stages. As the 90° phase shifters, lumped constant passive elements such as a capacitor, an inductor, and the like are used. FIG. 7 is a graph showing the attenuation characteristic of the band elimination filter 31. The band elimination filter 31 has a wider eliminated-bandwidth as the band elimination filter characteristic than that of the band elimination filter 1 according to the first preferred embodiment as shown in a dotted-line circle B.

Figure 8:
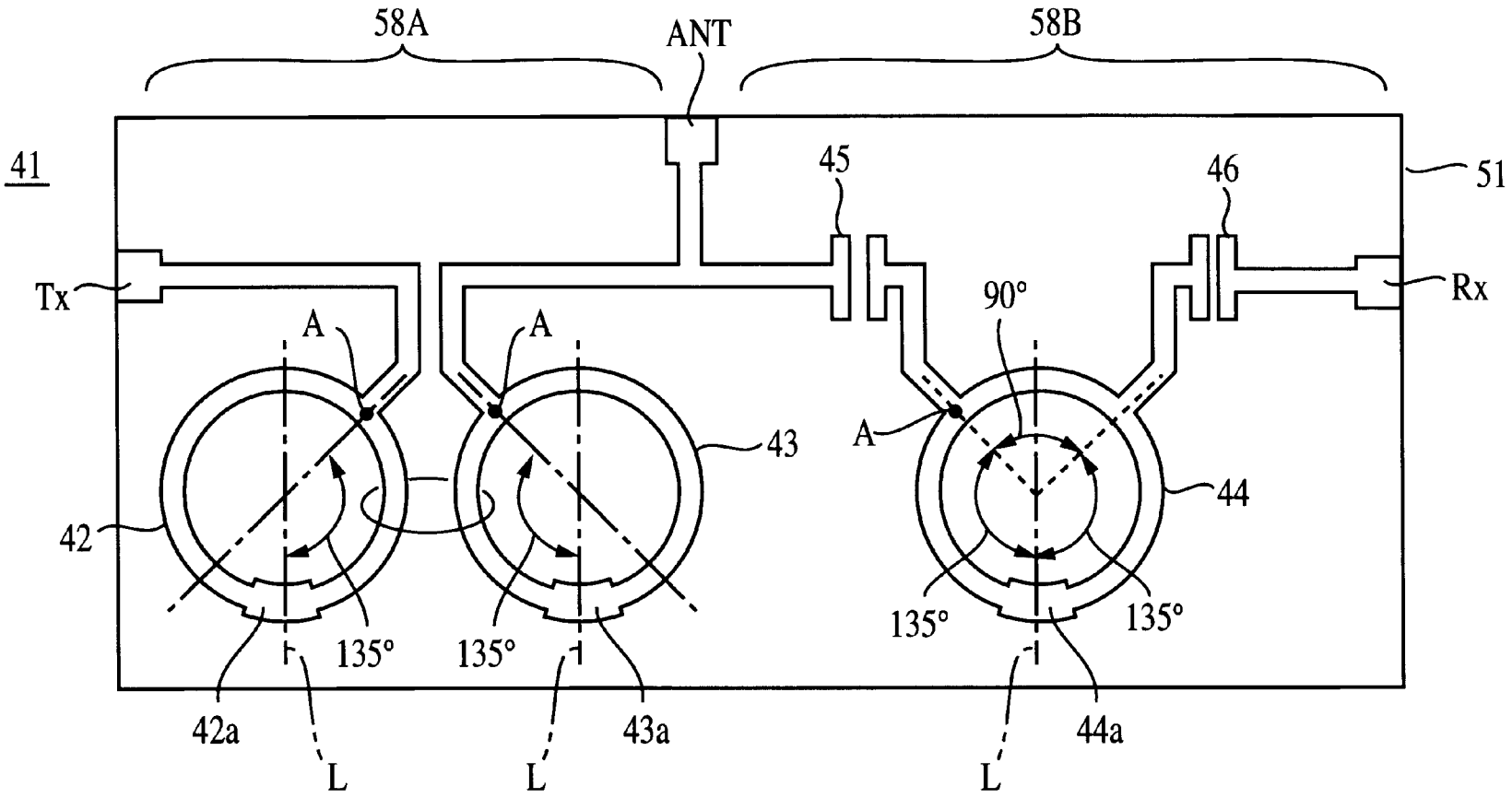
FIG. 8 is a plan view of a duplexer according to an preferred embodiment of the present invention.
Figure 9:
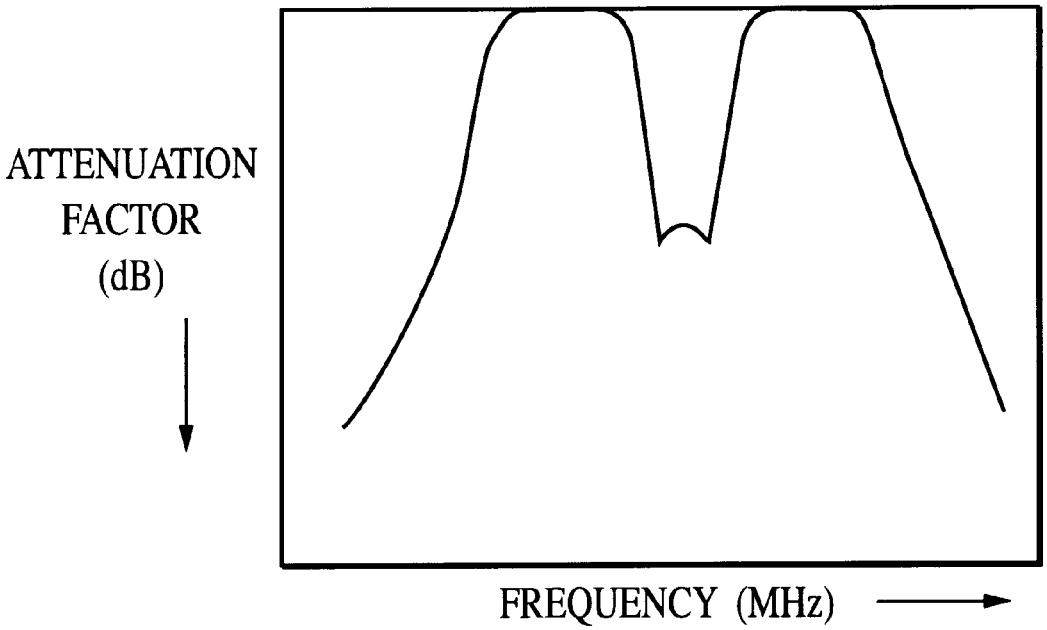
FIG. 9 is a graph showing the attenuation characteristic of a transmitting filter of the duplexer of FIG. 8.
Figure 10:
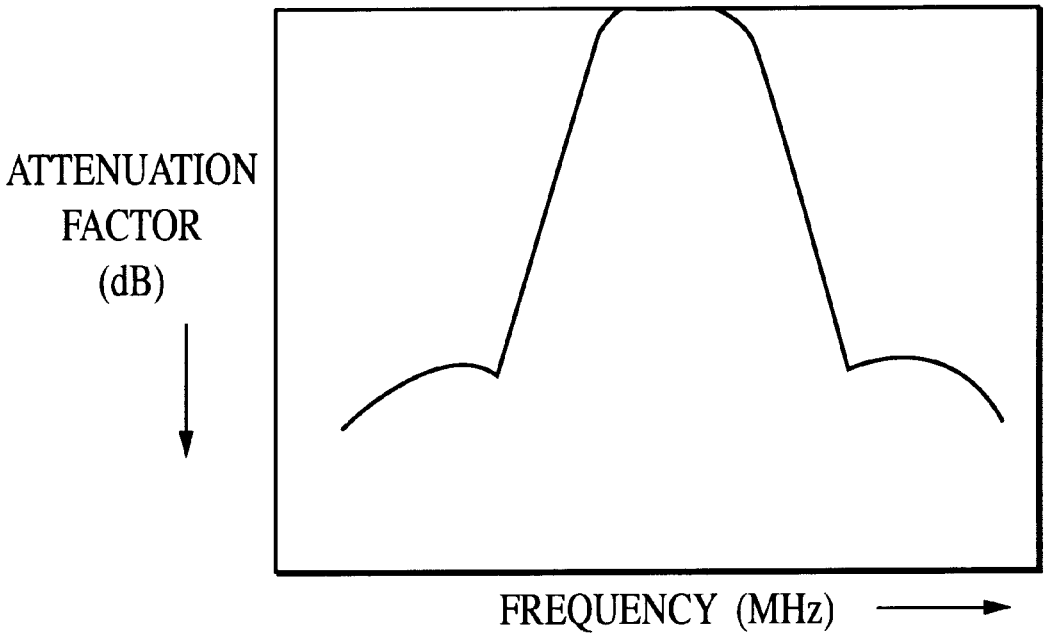
FIG. 10 is a graph showing the attenuation characteristic of a receiving filter of the duplexer of FIG. 8.

[Fifth Preferred Embodiment, FIGS. 8 through 10]

According to the fifth preferred embodiment, there is shown a duplexer for use in mobile radio communication apparatus such as motorcar telephones, portable telephones, and the like. As shown in FIG. 8, the duplexer 41 includes three ring shaped resonators 42, 43, and 44, one input-output terminal Tx electrically connected to the ring shaped resonator 42, one input-output terminal ANT electrically connected to the ring shaped resonator 43, and an output terminal Rx electrically connected to the ring shaped resonator 44 through a coupling capacitor 46, and a dielectric substrate 51. The input-output terminal Tx functions as a transmission side terminal, the input-output terminal ANT as an antenna terminal, and the output terminal Rx as a reception side terminal. The antenna terminal ANT is electrically connected to the ring shaped resonator 44 through the coupling capacitor 45, and also functions as an input terminal of the ring shaped resonator 44. On substantially the entire bottom surface of the dielectric substrate 51, a grounded conductor (not shown) is provided.

The ring shaped resonators 42, 43 have a circular ring shape, and are adapted to resonate in two orthogonal modes. For the ring shaped resonator 42, a wide-pattern portion 42*a* is provided at the position 135° electrical length distant in the clockwise direction from the connection A between the ring shaped resonator 42 and the transmission side terminal Tx. Similarly, for the ring shaped resonator 43, a wide-pattern portion 43*a* is provided at the position 135° electrical length distant in the anti-clockwise direction from the connection A of the ring shaped resonator 43 to the antenna terminal ANT. The wide-pattern portions 42*a*, 43*a* cause the characteristic impedances of a part of the lines of the ring shaped resonators 42, 43 to change stepwise, respectively, so that the ring shaped resonators 42, 43 resonate in a dual mode. More particularly, the ring shaped resonator 42 is divided into two regions, namely, those shown on the right-, left-hand sides in the drawing of FIG. 8, by the center line L of the wide-pattern portion 42*a*. A band-pass filter characteristic can be attained in the resonance of the ring shaped resonator 42 in the region where the transmission side terminal Tx is connected, while a band elimination filter (trap) characteristic can be obtained in the resonance of the ring shaped resonator 42 in the region where the transmission side terminal Tx is not connected. Similarly, the ring shaped resonator 43 is divided into two regions by the center line L of the wide-pattern portion 43*a*. A band-pass filter characteristic can be attained in the resonance of the ring shaped resonator 43 in the region where the antenna terminal ANT is connected, while a band elimination filter (trap) characteristic can be obtained in the resonance of the ring shaped resonator 43 in the region where the antenna terminal ANT is not connected. Thus, the ring shaped resonators 42, 43 function as a band elimination filter, respectively.

These ring shaped resonators 42, 43 are provided on a dielectric substrate 51 close to each other so that they are electromagnetically coupled. This produces, between the ring shaped resonators 42 and 43, the same operation/working-effect as in case of the ring shaped resonators 42, 43 cascaded through a 90° phase shifter. Thus, the ring shaped resonators 42, 43 form a transmission filter 58A comprising a two stage band elimination filter. FIG. 9 is a graph showing the attenuation characteristic of the transmission filter 58A.

The ring shaped resonator 44 has a circular ring shape, and presents two orthogonal modes of resonance. To the ring shaped resonator 44, the antenna terminal ANT and a reception side terminal Rx are connected so spaced that the electrical length between them is equal to 90°. For the ring shaped resonator 44, a wide-pattern portion 44*a* is provided at the position 135° electrical length distant in the anti-clockwise direction from the connection A of the ring shaped resonator 44 to the antenna ANT. The wide-pattern portion 44*a* causes the characteristic impedance of a part of the line of the ring shaped resonator 44 to change stepwise, so that the ring shaped resonator 44 resonates in a dual mode. More particularly, the ring shaped resonator 44 is divided into two regions, namely, those shown on the right-, left-hand side of the drawing of FIG. 8, by the center line L of the wide-pattern portion 44*a*. A first band-pass filter characteristic is obtained in the resonance of the ring shaped resonator 44 in the region where the antenna terminal ANT is connected. A second band-pass filter characteristic is obtained in the resonance of the ring shaped resonator 44 in the region where the reception side terminal Rx is connected. Thus, one ring shaped resonator 44 functions as two band-pass filters. As a result, the ring shaped resonator 44 forms a receiving filter 58B comprising a two-stage band-pass filter. FIG. 10 is a graph showing an attenuation characteristic of the receiving filter 58B.

The duplexer 41, constructed as described above, includes the transmitting filter 58A composed of the ring shaped resonators 42, 43, and the receiving filter 58B composed of the ring shaped resonator 44. The duplexer 41 outputs a transmitting signal applied through the transmission side terminal Tx from a transmission circuit system not shown, from the antenna terminal ANT through the transmitting filter 58A. On the other hand, the duplexer 41 outputs a receiving signal applied through the antenna terminal ANT, from the receiving terminal Rx to a receiving circuit system not shown, through the receiving filter 58B. As seen in the above description, it is unnecessary to insert an input-output coupling capacitor between the transmitting terminal Tx and the ring shaped resonator 42 and between the antenna terminal ANT and the ring shaped resonator 43. Moreover, since the duplexer including the ring shaped resonators 42 through 44 is provided on a dielectric substrate 51, for the duplexer, a so-called planar structure can be employed. This enables the duplexer to be miniaturized with reduction in the height.

[Other Embodiments]

The present invention can be modified without departing from the scope thereof. It is to be understood that the above-described preferred embodiments of the present invention are illustrative and not restrictive.

Figure 11:
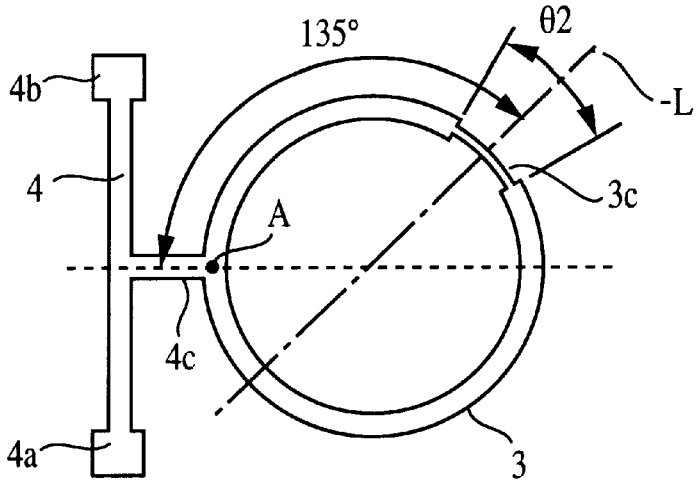
FIG. 11 is a plan view of another preferred embodiment of the present invention.
Figure 12:
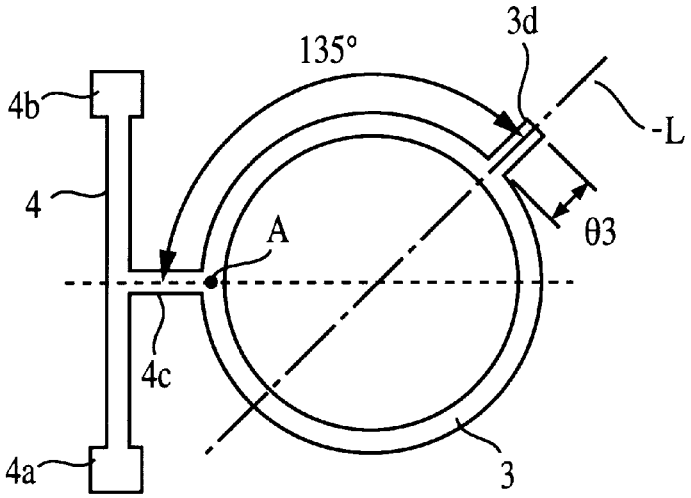
FIG. 12 is a plan view of further preferred embodiment of the present invention.
Figure 13:
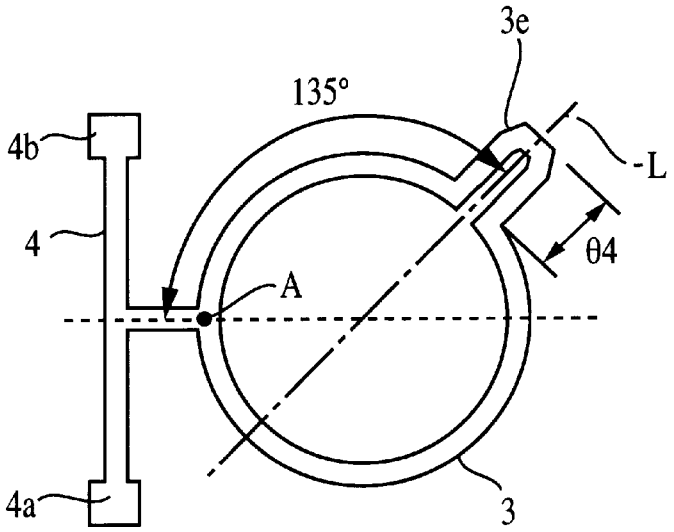
FIG. 13 is a plan view of still further preferred embodiment of the present invention.

The perturbation portion is composed of a lumped constant passive element such as the wide-pattern portion, the capacitor, and the like. However, it may be composed of a narrow-pattern portion 3*c* as shown in FIG. 11, a free-top stub portion 3*d* as shown in FIG. 12, or a parallel coupling line portion 3*e* as shown in FIG. 13, or the like. The trapping intensity can be controlled by changing the pattern width of the narrow-pattern portion 3*c*, the free-top stub portion 3*d*, or the parallel coupling line portion 3*e*, or by changing the electrical length θ2, θ3, or θ4.

Figure 14:
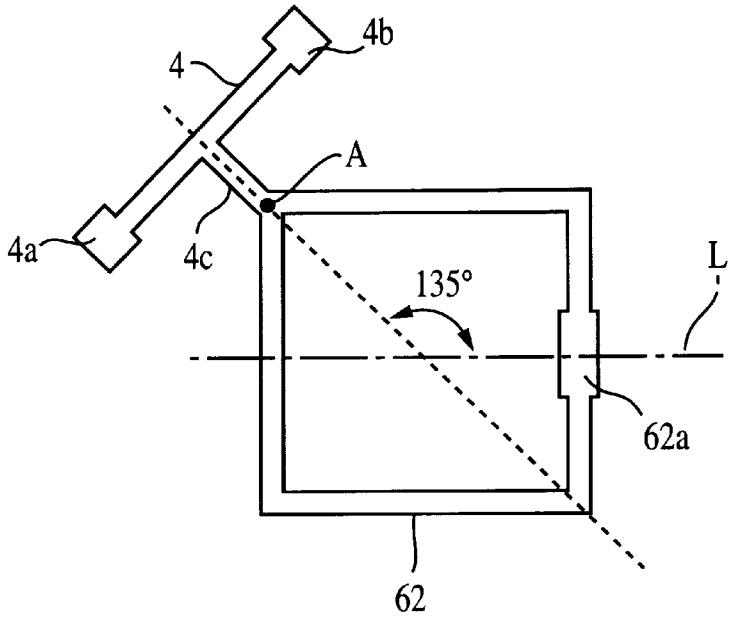
FIG. 14 is a plan view of another preferred embodiment of the present invention.

The ring shaped resonator may have an optional shape. For example, a ring shaped resonator 62 having a rectangular ring-shape as shown in FIG. 14 may be used. One input-output terminal 4 is electrically connected to a corner of the ring shaped resonator 62. A wide-pattern portion 62*a* is provided at the position 135° electrical length distant in the clockwise direction from the connection A where the input-output terminal 4 is connected to the ring shaped resonator 62.

While the invention has been particularly shown and described with reference to preferred embodiments thereof, it will be understood by those skilled in the art that the foregoing and other changes in form and details may be made therein without departing from the spirit of the invention.

What is claimed is:

1. A band elimination filter, comprising:

a ring shaped resonator adapted to resonate in two orthogonal modes combined together;

only one input-output terminal electrically connected to said ring shaped resonator for providing both input and output for said band elimination filter; and a perturbation portion disposed in said ring shaped resonator.

2. The band elimination filter according to claim 1, wherein said perturbation portion is disposed at at least one of portions at distances of electrical lengths 45° and 135° from a connecting portion where said input-output terminal is connected to said ring shaped resonator.

3. The band elimination filter according to claim 1, wherein said perturbation portion is composed of a lumped constant passive element.

4. The band elimination filter according to claim 1, wherein said perturbation portion is composed of a portion of said ring shaped resonator at which a pattern width is different from the other portion of said ring shaped resonator.

5. The band elimination filter including a plurality of said band elimination filters of claim 1 which are connected to each other with 90° phase shift.

6. A duplexer comprising:

a transmission filter, comprising at least one first ring shaped resonator adapted to resonate in two orthogoonal modes combined together;

only one first input-output terminal electrically connected to said first ring shaped resonator for providing both input and output for said transmission filter; and a second perturbation portion disposed in said second ring shaped resonator.

7. The duplexer according to claim 6, wherein at least one of said first and second perturbation portions is disposed at at least one of portions at distances of electrical lengths 45° and 135° from a connecting portion where the corresponding one of said first and second input-output terminals is connected to the corresponding one of said first and second ring shaped resonators.

8. The duplexer band elimination filter according to claim 6, wherein at least one of said first and second perturbation portions is composed of a lumped constant passive element.

9. The duplexer band elimination filter according to claim 6, wherein at least one of said first and second perturbation portions is composed of a portion of at least one of said first and second ring shaped resonators at which a pattern width is different from the other portion of at least one of said first and second ring shaped resonators.

10. A band elimination filter according to claim 1, wherein said input-output terminal has one connecting portion and said input-output terminal is directly conductively connected to said ring-shaped resonator only at said one connecting portion.

11. A band elimination filter according to claim 2, wherein said input-output terminal is directly conductively connected to said ring-shaped resonator only at said connecting portion.

12. A band elimination filter according to claim 6, wherein at least one of said first and second input-output terminals has one connecting portion and said at least one input-output terminal is directly conductively connected to the corresponding one of said ring shaped resonators only at said one connecting portion.

13. A band elimination filter according to claim 7, wherein the corresponding said input-output terminal is directly conductively connected to the corresponding said ring shaped resonator only at said connecting portion.

* * * * *